United States Patent [19]

Detweiler et al.

[11] Patent Number: 4,971,370

[45] Date of Patent: Nov. 20, 1990

[54] SELF-RELEASING DECK LID LATCH

[75] Inventors: Charles A. Detweiler, Durand; Gerrit Beneker, Auburn Hills; Charles R. Martus, Troy; Peter Henning, Pontiac, all of Mich.

[73] Assignee: Lectron Products, Inc., Rochester Hills, Mich.

[21] Appl. No.: 343,161

[22] Filed: Apr. 25, 1989

[51] Int. Cl.[5] ..... E05C 3/26

[52] U.S. Cl. ..... 292/45; 292/DIG. 43

[58] Field of Search ..... 292/45, 52, 201, 216, 292/DIG. 24, DIG. 43

[56] References Cited

U.S. PATENT DOCUMENTS

| | | | |
|---|---|---|---|
| 3,347,584 | 10/1967 | Johnstone | 292/216 X |
| 3,386,761 | 6/1968 | Johnstone et al. | 292/201 |
| 4,422,522 | 12/1983 | Slavin | 292/DIG. 43 X |

*Primary Examiner*—Richard E. Moore

*Attorney, Agent, or Firm*—Harness, Dickey & Pierce

[57] ABSTRACT

An improved deck lid lock with remote release for motor vehicles. The deck lid lock employs a solenoid operated axially movable armature which is directly coupled to a rotatable lever. The lever is normally biased to a latched position. The lever is lockingly engageable with a rotatable pawl which is normally biased to a latched position. The pawl engages a pair of rotatable, asymmetrically oriented striker cams which are normally biased to an unlatched position. The striker cams define a cavity for engaging a striker. Upon energization of the solenoid, the armature is attracted to the solenoid causing it to rotate the lever so as to disengage the pawl. The normal biasing of the striker cams overcome the biasing of the pawl to rotate the striker cams to the unlatched position thereby opening the deck lid. When the deck lid is closed, contact with the striker over-rotates the striker cams permitting the pawl to rotate to a latched position thereby lockingly engaging the lever. The deck lid lock further includes a rotatable key cam which acts on the lever to enable release of the deck lid through conventional manual key actuations. Improved electrical switch means are provided for signaling when the deck lid is open.

26 Claims, 3 Drawing Sheets

SELF-RELEASING DECK LID LATCH

BACKGROUND AND SUMMARY OF THE INVENTION

This invention relates to a remote mechanical release mechanism and particularly to one adapted for releasing the deck (i.e., trunk) lid of a passenger car motor vehicle.

As a convenience feature, motor vehicle manufacturers often equip their products with remote release mechanisms for the vehicles trunk lid. This feature enables the trunk lid to be released from inside the passenger compartment so that the driver does not have to remove the keys from the ignition and exit the vehicle to unlatch the deck lid externally. Various designs for such devices are presently known. Although remote release mechanisms according to the prior art perform satisfactorily, there is a continuing desire to reduce their complexity, size and cost, while providing acceptable operating and durability characteristics.

In accordance with the present invention, an improved solenoid actuated deck lid lock with remote release is provided which is compact so as to permit installation in limited space applications. The present invention incorporates self-releasing design features such that reduced force and solenoid output requirements are possible. As will be hereafter detailed, the present invention incorporates internal components designed to provide a mechanical advantage such that unlocking force requirements are minimized. Additionally, the subject device permits application of a smaller solenoid assembly while maintaining or improving on performance characteristics.

Additional benefits and advantages of the present invention will become apparent to those skilled in the art to which this invention relates from the subsequently description of the preferred embodiments and the appended claims taken in conjunction with the accompanying drawings.

DETAILED DESCRIPTION OF THE INVENTION

Figure 1:
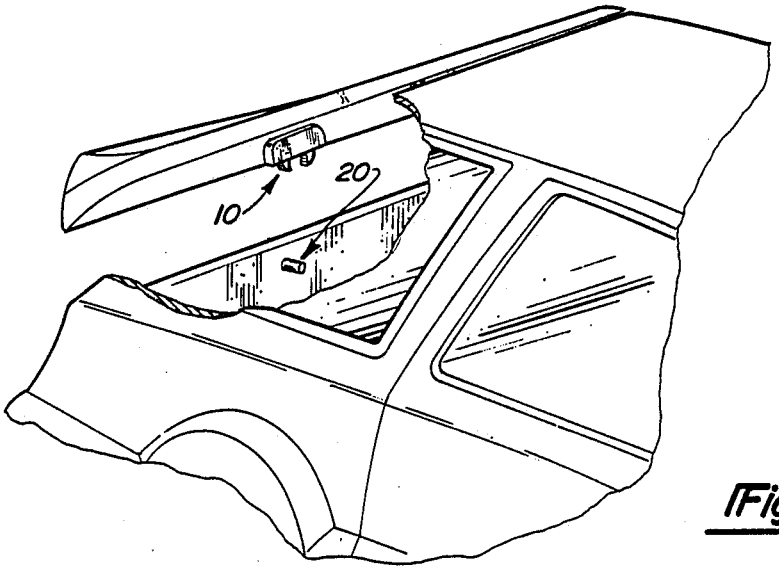
FIG. 1 is a diagrammatic representation of a deck lid lock with remote releasing shown in operative association with a typical automobile according to the preferred embodiment of the present invention.

FIG. 1 illustrates a deck lid lock with remote release according to the preferred embodiment of the present invention which is designated by reference number 10.

Deck lid lock 10 is illustrated in operable association with a deck lid to engage locking bar ("striker") 20 affixed to the vehicle's rear compartment structure, or the positioning of these components may be reversed, depending on the vehicular application.

Figure 2:
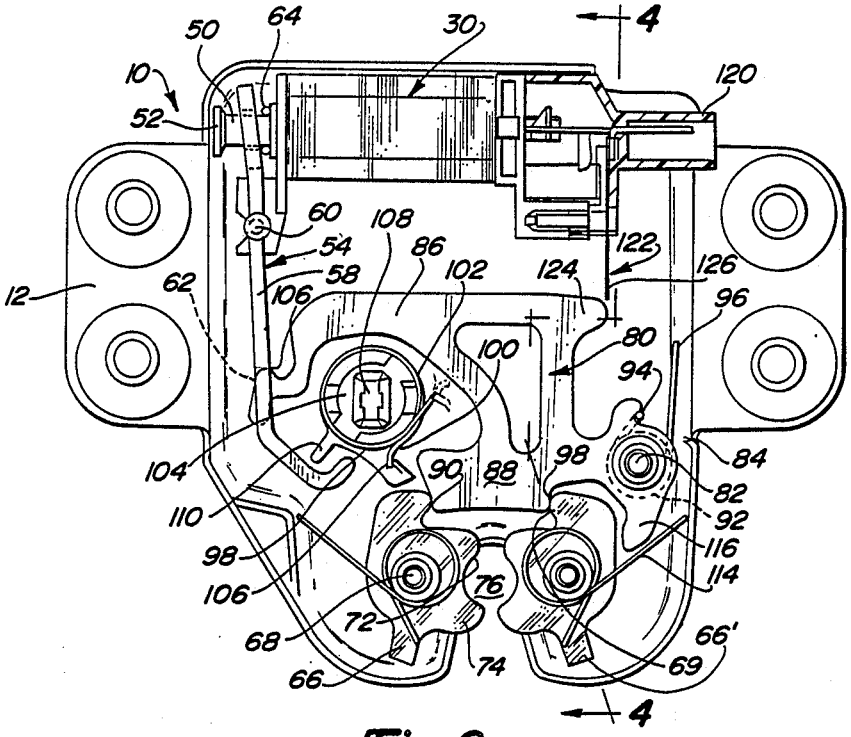
FIG. 2 is a side elevational view of a deck lid lock with remote release shown in a latched position which is partially cut away showing the various internal components thereof.
Figure 3:
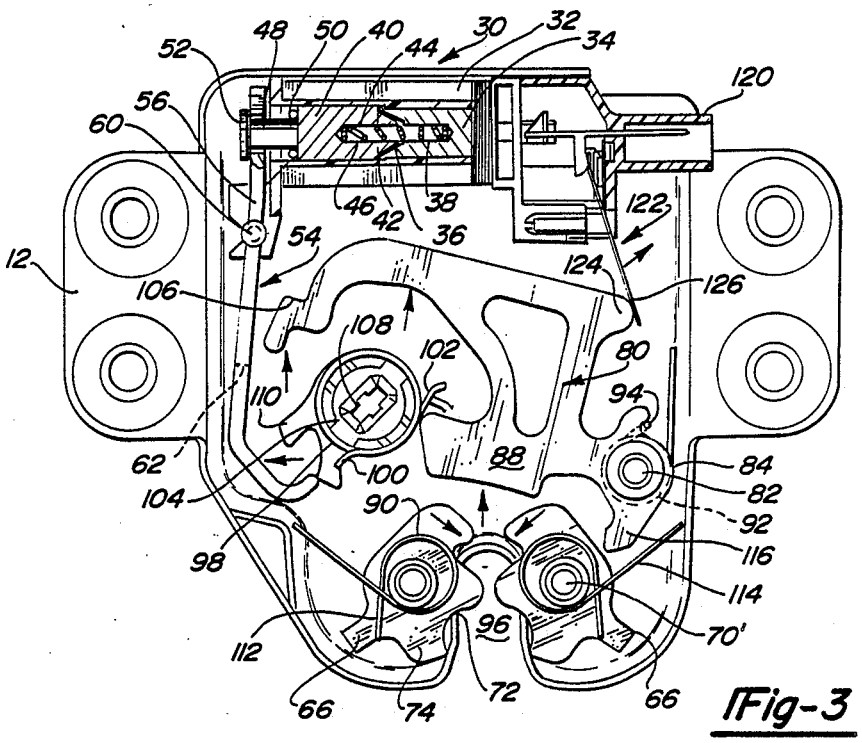
FIG. 3 is similar to FIG. 2 except that the positioning and operation of the various internal components are shown in an unlatched position according to the preferred embodiment of the present invention.
Figure 4:
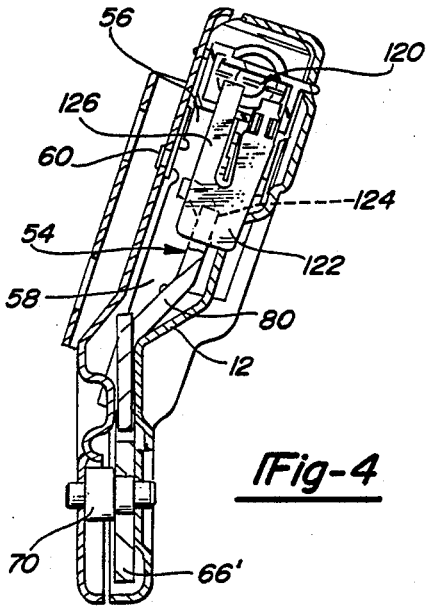
FIG. 4 is a cross-sectional view taken along lines 4—4 of FIG. 2.
Figure 5:
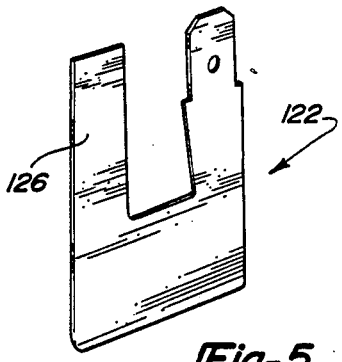
FIG. 5 is a perspective view of the electrical switching device incorporated within a deck lid lock according to the present invention.
Figure 6:
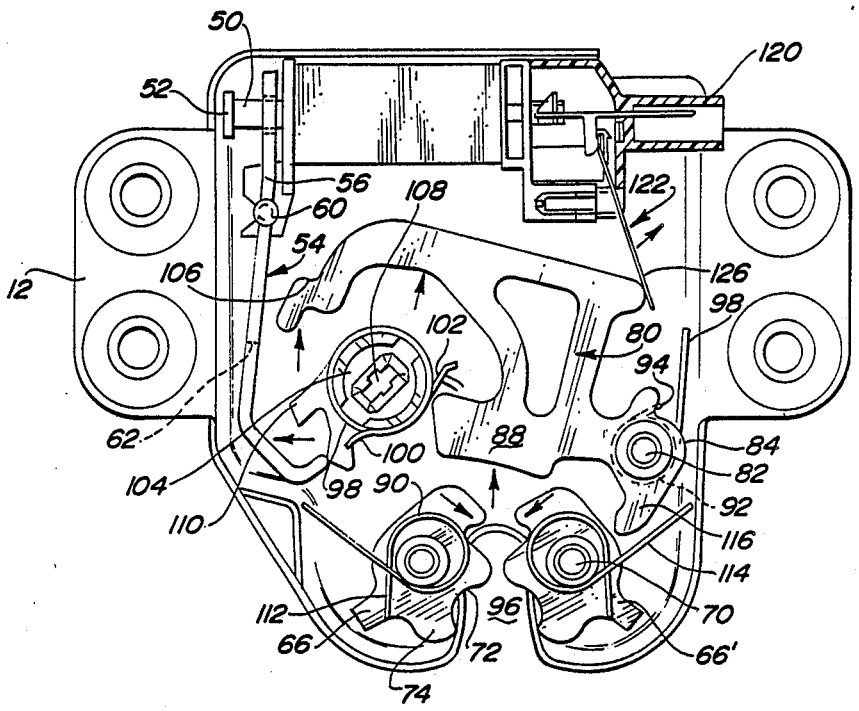
FIG. 6 is similar to FIG. 3 except that a deck lid lock is shown in a manually unlatched position according to the preferred embodiment of the present invention.

Referring now to FIGS. 2, 3, and 6, deck lid lock 10 is shown having base plate 12 which forms a structural support for the remaining components of the lock. Solenoid assembly 30 includes windings 32 which surrounds pole piece 34 and which is rigidly affixed to base plate 12. Pole piece 34 is fixedly mounted within solenoid assembly 30. Pole piece 34 further defines a convex frusto-conical surface 36 at one of its axial ends. Counterbore 38 is formed within pole piece 34 at its end adjacent surface 36.

Armature 40 is movable in an axial direction through a limited range of motion and includes a frusto-conical surface 42 at one axial end corresponding in configuration to that of pole piece surface 36. Counterbore 44 is formed within armature 40 at its end adjacent surface 42. Spring 46 is disposed within the axially aligned counterbores 38 and 44 of pole piece 34 and armature 40, respectively. At the opposite axial end of armature 40, a plunger 48 is provided having a central stem 50 and cap 52. Armature 40 is slidably movable from a first (de-energized) position shown in FIG. 2, to a second (energized) position as shown in FIG. 3.

Latch lever 54 is pivotably movable from a first (latched) position shown in FIG. 2, to a second (unlatched) position as shown in FIGS. 3 and 6. Latch lever 54 includes first and second legs 56 and 58, respectively, which are disposed about opposite sides of pivot axis 60. Lever legs 56 and 58 are designed such that they provide a center of gravity location for latch lever 54 which is at or near pivot axis 60. This balancing renders deck lid lock 10 relatively insensitive to inertial inputs which have been found to produce inadvertent lock release in some common lock designs. First lever leg 56 further includes a bore 61 through which plunger stem 50 extends. Leg 56 is interconnected and engageable with plunger 48 via cap 52. Second leg 58 further defines an engaging edge 62. Spring 64 is provided to normally bias latch lever 54 to a latched position.

To provide locking means for capturing striker 20 when the deck lid is closed, a pair of striker cams 66 and 66' are provided. Striker cams 66 and 66' are symmetrically oriented and are independently rotatable about pins 68 and 70, respectively, between a normally latched position shown in FIG. 2, and an unlatched position shown in FIGS. 3 and 6. Specifically, striker cams 66 and 66, each have first and second arms 72 and 74, respectively, defining locking cavity 76 which act to engagingly surround striker 20 during locked operation of the present invention according to the preferred embodiment.

Pawl 80 is rotatable about pivot pin 82 and is movable from its normal latched position shown in FIG. 2, to a clockwise displaced unlatched position. Pawl 80 includes first and second legs 86 and 88, respectively, which are generally disposed about opposite lateral sides of pivot pin 82. Second pawl leg 88 is configured to concurrently engage an upper surface 67 provided on each of striker cams 66 and 66, when the components are disposed in the latched position. The edge surfaces 90 provided on second pawl leg 88 are angularly configured to be "self-releasing" from surface 67 when deck lid lock 10 is manually or automatically unlatched.

Pawl 80 is normally biased in a counterclockwise direction about pivot pin 82 by torsion spring 92. Torsion spring 92 has extending arms 94 and 96 which engage pawl 80 and base plate 12, respectively, so as to bias pawl 80 toward a counterclockwise latched position as shown in FIG. 2. Torsion spring 98 has extending arms 100 and 102 which engage key cam 104 and base plate 12, respectively, for normally biasing key cam 104 in a counterclockwise direction. First pawl leg 86 further includes an edge surface 106 operable to engage lever engaging edge 62 provided on second lever leg 58.

Key cam 104 is journaled for rotation within base plate 12 and includes a first radially projecting cam tab 105 and a rectangularly shaped slot 108 which engages a similarly shaped rod extending from the trunk lid lock cylinder (not shown). Torsion spring 98 wraps around key cam 104 and engages first cam tab 105 at end 100. Key cam 104 is also provided with a second cam tab 110 for engagingly contacting first pawl leg 86 upon manual release of lever leg 58 from engaging edge 62 upon additional clockwise rotation of key cam 105. Second cam tab 110, provides a positive mechanical release of deck lid lock 10 in the event the latch mechanism becomes inoperable due to exposure to rust, dirt or general abuse, even if remote release via the solenoid energization is not possible.

FIG. 2 illustrates the orientation and cooperation of the components defining deck lid lock 10 when a deck lid is closed and locked. In that condition, striker cams 66 and 66, engagedly capture striker 20 within locking cavity 76 and are maintained in the latched position shown through engagement between edge surface 106 provided on first pawl leg 86 and engaging edge 62 located on second lever leg 60.

When the deck lid is closed, striker 20 enters locking cavity 76 and engages striker cam arm 72, urging striker cams 66 and 66' to rotate in symmetrically opposite directions against the biasing of torsion springs 112 and 114, respectively. During such motion of striker 20, continued rotation of striker cams 66 and 66, allows pawl 80 to rotate in a counterclockwise direction so as to position edge surface 90 of second pawl leg 88 between recessed surface 67 provided on each striker cam 66 and 66,. This rotation of pawl 80 causes the edge surface 106 provided on first pawl leg 86 to lockingly capture engaging edge 62 located on second lever leg 60. This locking engagement definitively positions second pawl leg 88 relative to upper surface 67 so as to prevent striker cams 66 and 66' from rotating to the unlatched position, thereby capturing striker 20 so as to lock the deck lid. Additionally, pawl 80 has an extension member 116 extending downwardly from pivot pin 82 and which is configured to contact one of striker cams 66 and 66, when striker 20 engages striker cams 66 and 66,. Extension 116 assists spring 92 in urging pawl 80 toward the latched position. This insures that edge surface 106 will engage lever engaging edge 62 before the deck lid can bounce off its stops (not shown) thereby inhibiting unlatching during slamming of the deck lid.

When it is desired to release the deck lid remotely, voltage is applied to windings 32, causing armature 40 to be attracted toward pole piece 34. This attraction causes plunger 48 to move toward pole piece 34, thereby cap 52 engages first lever leg 56, wherein pivot axis 60 enables second lever leg 58 to pivotably move in a clockwise direction. Upon this movement, second lever leg 58 becomes disengaged from first pawl leg 86 enabling striker cams 66 and 66, to urge pawl 80 in a clockwise direction against the biasing of torsion spring 92 and clear of second lever leg 58. Pawl 80 is configured such that upon disengagement of second lever leg 58 from first pawl leg 86, the biasing force of torsion springs 112 and 114 acting on striker cams 66 and 66,, respectively, and the "self-releasing" angular configuration of mating surfaces 67 and 90, urges pawl 80 to rotate to the unlatched position shown in FIG. 3. More specifically, rotation of striker cams 66 and 66' to an unlatched position results in clockwise rotation of second pawl leg 88 since second pawl leg 88 is designed to continuously engage at least one of striker cams 66 and 66'. This continued engagement acts to rotate pawl 80 to an unlatched position. Further, the peripheral angular surface configurations of upper surface 67 provided on striker cams 66 and 66, and surface 90 of second pawl leg 88 are designed to allow the biasing of torsion springs 112 and 114 to overcome the biasing of torsion spring 92 when edge surface 106 is disengaged from lever engaging edge 62. The predefined angular surface configurations of surfaces 67 and 90 and the engagement therebetween combine with the greater biasing force of torsion springs 112 and 114 to provide the "self-releasing" mechanical advantage characteristic. Striker 20 is thereby released from cavity 76 which enables the deck lid to be opened.

Release of the deck lid through external actuation (key) of a latch cylinder is provided by rotating key cam 104 in a clockwise direction such that first cam tab 105 acts directly on second lever leg 58 thereby rotating second lever leg 58 in a clockwise direction. This rotation of second lever leg 58 mechanically releases edge surface 106 from lever engaging edge 62 thereby permitting release of striker 20 as previously detailed. The orientation of manually released deck lid lock 10 is illustrated in FIG. 6.

FIGS. 2, 3 and 6 further illustrate additional components which are conventionally provided with deck lid lock 10, such as electrical connector 120 which enables convenient connection to the vehicle wiring harness. Deck lid lock 10 further includes lock condition switch 122 which is used to provide a warning that the deck lid is in a released (open) condition which is indicated through contact of pawl extension 124 with switch element 126 when pawl 80 is rotated to its clockwise (unlatched) position.

As is evident from the appended figures and above description, deck lid lock 10 incorporates advanced design features so as to provide a simple and durable deck lid device. The advanced design features provide mechanical advantages which reduce the frictional forces which must be overcome prior to remote release of lock 10 over commonly employed locking methods. Use of a conventional armature 40 having a plunger 48 which directly impacts on lever arm 56 generates a sufficient force to unlatch the components.

Deck lid lock 10 is very compact which is attributable to the utilization of a "self-releasing" pawl 80 and striker cams 66 and 66' arrangement. Therefore, solenoid 30 can be efficiently sized and packaged for limited installation space applications.

While the above description constitutes the preferred embodiment of the present invention, it will be appreciated that the invention is acceptable to modification, variation and change without departing from the proper scope and fair meaning of the accompanying claims.

We claim:

1. A deck lid lock with remote release adapted to be mounted to a motor vehicle structure and engageable with a striker, comprising:

a base plate;

an actuator having first and second positions;

actuation means for causing said actuator to move from said first position to said second position;

a lever rotatably mounted to said base plate and coupled to said actuator such that movement of said actuator to said second position causes said lever to rotate from a first position to a second position;

first bias means for exerting a relatively small bias force on said lever to urge said lever toward said first position;

a pawl having a stop surface and being rotatable with respect to said base plate from a first position to a second position, said pawl lockingly engaging said lever when said pawl and said lever are in said first position, respectively;

latching means rotatable with respect to said base plate from a first position wherein said striker is captured when the deck lid is closed to a second position wherein said striker is released, said latching means including a cam surface engageable with said stop surface when said pawl and latching means are in said first position, respectively; and second bias means for exerting a relatively large bias force on said latching means to urge said latching means toward said second position;

whereby the interface between said stop surface and said cam surface is such that when said lever is rotated to said second position to unlock said pawl, the bias force exerted by said second bias means on said latching means is sufficient to cause both said latching means and said pawl to rotate to said second position, respectively, and release said striker.

2. The deck lid lock according to claim 1 wherein said actuation means comprises a solenoid having a pole piece and a movable armature, said armature being coupled to said actuator for causing said actuator to move from said first position to said second position upon energization of said solenoid.

3. The deck lid lock according to claim 2 wherein said lever is rotated to said second position by energization of said solenoid so as to disengage said pawl from said lever thereby enabling said latching means to rotate to said second position so as to release said striker.

4. The deck lid lock according to claim 3 wherein said latching means comprises a pair of striker cams, said striker cams defining a cavity for engagingly capturing said striker when said deck lid is closed.

5. The deck lid lock according to claim 4 wherein said striker cams are restricted by said pawl from rotating to said unlatched position when said pawl engages said lever, and said striker cams are free to rotate to said unlatched position when said lever is disengaged from said pawl.

6. The deck lid lock according to claim 5 wherein said pawl further comprises an extension member engageable with one of said striker cams, such that when said striker urges said striker cams toward said first position, one of said striker cams acts on said extension member so as to rotate said pawl to said first position.

7. A deck lid lock with remote release adapted to be mounted to a motor vehicle structure and engageable with a striker, comprising:

a base plate;

a solenoid pole piece;

a solenoid winding magnetically coupled to said pole piece;

an armature axially movable between a position displaced from said pole piece to a position attracted to said pole piece upon energization of said solenoid windings;

a lever fixed for rotation with respect to said base plate about a first pivot, said lever coupled to said armature whereby energization of said winding causes said armature to act on said lever thereby rotating said lever from a latched position to an unlatched position;

a pawl fixed for rotation about a second pivot from an unlatched to a latched position, said pawl lockingly engaging said lever when said lever is in said latched position, and free from engagement with said lever when said lever is in said unlatched position;

means for biasing said pawl so as to urge said pawl toward said latched position;

a pair of striker cams each rotatable about a distinct pivot from a latched to an unlatched position, said striker cams having a first and second arm defining a cavity, said cavity acting to engagedly capture said striker when said deck like lock is in a latched position, said striker cams restricted from rotating to said unlatched position when said pawl engages said lever in a latched position, said striker cams free to rotate to said unlatched position when said lever is disengaged from said pawl;

a key cam rotatably carried by said base plate and having a first cam tab engageable with said lever to urge said lever to said unlatched position, and a second cam tab engageable with said pawl to urge said pawl to said unlatched position upon disengagement of said lever from said pawl;

key cam biasing means for biasing said key cam in a direction opposite that required for engagement of said first cam tab with said lever;

striker cam biasing means for biasing said striker cams toward said unlatched position such that said lever may be moved to said unlatched position either by energization of said solenoid winding or by rotation of said key cam in a direction opposing said key cam biasing means, thus enabling said striker cams to rotate to said unlatched position so as to release said striker; and whereby whenever said deck lid is closed, said striker rotatably urges said striker cams in a direction opposing said striker cams biasing means so as to permit said pawl to rotate to said latched position thereby causing said pawl to lockingly engage said lever.

8. The deck lid lock according to claim 7 wherein said solenoid pole piece is affixed to said base plate.

9. The deck lid lock according to claim 7 wherein said pawl is further defined as having first and second legs such that said first pawl leg engages said lever and said second pawl leg engages said striker cams.

10. The deck lid lock according to claim 9 wherein said lever defines an edge engageable with said first pawl leg.

11. The deck lid lock according to claim 10 wherein said first pawl leg further comprises an edge surface, said edge surface engageable with said edge of said lever when said lever is in said latched position.

12. The deck lid lock according to claim 11 wherein said striker cams are restricted from rotating to said unlatched position by said second pawl leg when said first pawl leg edge surface engages said edge of said lever.

13. THe deck lid lock according to claim 7 wherein said means for biasing said pawl comprises a torsion spring wrapped around said second pivot and engaging said base plate and further engaging said pawl.

14. The deck lid lock according to claim 7 wherein said strike cam biasing means comprises a pair of torsion springs independently wrapped around one of said pivots, said torsion springs having arms engaging said base plate and said striker cam.

15. A deck lid lock with remote release adapted to be mounted to a motor vehicle structure and engageable with a striker, comprising:

a base plate;

a solenoid pole piece affixed to said base plate;

a solenoid winding surrounding said pole piece;

an armature axially movable between a position displaced from said pole piece to a position attracted to said pole piece upon energization of said winding;

a lever fixed for rotation with respect to said base plate about a first pivot, said lever having a first lever leg coupled to said pole piece on one side of said first pivot, and a second lever leg positioned on the opposite side of said first pivot such that the center of gravity of said lever is located substantially adjacent said first pivot, whereby energization of said winding causes said armature to move toward said pole piece so as to engage said first lever leg, said engagement causing said second lever leg to rotate from a latched position to an unlatched position;

a pawl rotatable about a second pivot from an unlatched to a latched position, said pawl having first and second legs, said first pawl leg engageable with said second lever leg when said second lever leg is in said latched position, and free from engagement when said second lever leg is in said unlatched position;

means for biasing said pawl for urging said pawl toward said latched position;

a key cam rotatably carried by said base plate and having a first cam tab engageable with said second lever leg to urge said second lever leg to said unlatched position;

a pair of symetrically oriented striker cams independently rotatable about a third and fourth pivot from a latched to an unlatched position, said striker cams having a first and second arm defining a cavity therebetween, such that said cavity acts to engageably capture said striker when said deck lid lock is latched, said striker cams further defining an upper surface for lockingly engaging said second pawl leg when said first pawl leg engage said second lever leg in said latched position;

striker cam biasing means for urging said striker cams toward said unlatched position, whereby said second lever leg may be rotated to said unlatched position either by energization of said solenoid winding or by rotation of said key cam, whereby said second lever leg disengages said first pawl leg thereby enabling said striker cams to rotate to said unlatched position releasing said striker; and whereby whenever said deck lid is closed, said striker acts on said striker cams so as to rotate said striker cams past said unlatched position permitting said pawl to rotate to said latched position thereby causing said first pawl leg to lockingly engage said second armature leg.

16. The deck lid lock according to claim 15 wherein rotation of said second lever leg to said unlatched position either by energization of said solenoid winding or by rotation of said key cam acts to disengage said second lever leg from said first pawl leg, such that said striker cam biasing means overcome said means for biasing said pawl, thereby permitting said striker cams to rotate to said unlatched position while urging said second pawl leg to rotate said pawl to an unlatched position.

17. The deck lid lock according to claim 16 wherein engaging surfaces of said striker cams and said second pawl leg are angularly configured such that engagement therebetween permits said striker cam biasing means to overcome said means for biasing said pawl when said second lever leg is rotated to said unlatched position.

18. The deck lid lock according to claim 15 wherein said second lever leg defines an edge engageable with said first pawl leg when said lever is in said latched position, said first pawl leg further defining an edge surface engageable with said edge of said second lever leg.

19. The deck lid lock according to claim 15 wherein said means for biasing said pawl comprises a torsion spring wrapped around said second pivot and engaging said base plate and further engaging said pawl, said torsion spring acting to bias said pawl toward a latched position.

20. The deck lid lock according to claim 15 wherein said striker cam biasing means comprises a pair of torsion springs, one of which is wrapped around each striker cam pivot, said torsion springs having ends respectively engaging said base plate and one of said striker cams so as to independently bias each of said striker cams toward an unlatched position.

21. The deck lid lock according to claim 15 wherein said lever is generally planar in shape defining a pair of face surfaces on opposite sides of said lever, and wherein said solenoid winding and said pole piece are positioned on the same side of said lever.

22. The deck lid lock according to claim 15 further comprising electrical switching means, said electrical switching means operable to identify when said deck lid is in a released position.

23. The deck lid lock according to claim 22 wherein said electrical switching means comprises a generally "U"-shaped switch element, said switch element operable to contact an electrical terminal when said deck lid lock is in said unlatched position.

24. The deck lid lock according to claim 23 wherein said "U"-shaped switch element is elastically rotated into contact with said terminal by engagement with said pawl when said pawl rotates to an unlatched position.

25. The deck lid lock according to claim 15 wherein said key cam further comprises a second cam tab for engaging said first pawl leg via rotation of said key cam following disengagement of said lever from said first pawl leg, said second cam tab acting to manually rotate said pawl whenever said striker cams are struck in a latched position.

26. The deck lid lock according to claim 15 wherein said pawl further includes an extension member that is engaged by one of said striker cams during rotation of said striker cams past said latched position by said striker, whereby said pawl extension member urges said pawl to said latched position to insure engagement of said second lever leg and said first pawl leg.

* * * * *